United States Patent [19]

Hinchcliffe et al.

[11] 3,951,103

[45] Apr. 20, 1976

[54] APPARATUS FOR CREATING PROTECTIVE COATINGS ON CARBON ARTICLES

[75] Inventors: Alan Hinchcliffe, Sheffield; Kenneth Johnson, Doncaster, both of England

[73] Assignee: British Steel Corporation, London, England

[22] Filed: Sept. 16, 1974

[21] Appl. No.: 506,581

Related U.S. Application Data

[62] Division of Ser. No. 299,455, Oct. 20, 1972.

[30] Foreign Application Priority Data

Oct. 22, 1971 United Kingdom ..... 49261/71

[52] U.S. Cl. ..... 118/315; 118/321; 427/422; 118/620

[51] Int. Cl.[2] ..... B05C 9/06

[58] Field of Search ..... 118/315, 314, 320, 321, 118/47, 302; 117/105.2, 105.4; 427/422, 425

[56] References Cited

UNITED STATES PATENTS

| | | | |
|---|---|---|---|
| 1,256,599 | 2/1918 | Schoop | 118/321 |
| 1,281,404 | 10/1918 | Marquess | 118/321 |
| 1,978,415 | 10/1934 | Collins | 118/315 |
| 3,019,014 | 1/1962 | Miksis | 117/105.4 |
| 3,048,061 | 8/1962 | Mele | 117/105.2 |
| 3,730,133 | 5/1973 | Cordiano et al. | 118/314 |
| 3,791,842 | 2/1974 | Neal | 118/315 |
| 3,864,164 | 2/1975 | Hinchcliffe et al. | 117/105.4 |

*Primary Examiner*—Mervin Stein
*Assistant Examiner*—Douglas Salser
*Attorney, Agent, or Firm*—Cushman, Darby & Cushman

[57] ABSTRACT

The invention relates to a method and apparatus for coating carbon articles, such as carbon electrodes for use in steelmaking, with aluminium and refractory materials.

The method comprises in a single operation, spraying aluminium in a molten state on to the surface, and immediately spraying refractory material on to the aluminium coating so formed.

The apparatus includes spray heads, by which the aluminium and refractory materials are sprayed, the spray heads being located alongside each other and moved relatively to the carbon electrode simultaneously, the distance apart of the spray heads being sufficient to ensure that there is virtually no interference between the sprays of aluminium and refractory material, and also to ensure that the heat of the molten aluminium does not dry out the refractory material before it reaches the surface of the carbon article.

1 Claim, 2 Drawing Figures

APPARATUS FOR CREATING PROTECTIVE COATINGS ON CARBON ARTICLES

This is a division of application Ser. No. 299,455, filed Oct. 20, 1972.

This invention relates to methods of and apparatus for creating protective coatings on the surfaces of carbon articles. The invention is a modification of the basic process described and claimed in British Pat. Nos. 1,026,055 and 1,151,071. In these patent specifications are described methods of coating carbon articles with aluminium layers and then applying to the aluminium layer a layer of refractory material. As practised up to date these methods have involved applying the aluminium by use of an electric arc to atomise the aluminium and compress air to blow the atomised aluminium on to the surface of the carbon article. The article is then allowed to cool sufficiently to paint on to the aluminium surface a slurry containing refractory material.

We have now found that it is not only possible to spray the refractory material on to the aluminium coating but that we can carry out the two coating steps in a single operation with consequent saving in time and effort.

According to the invention a method of creating a protective coating on the surface of a carbon article comprises, in a single operation, spraying aluminium in molten state on to the surface and immediately spraying refractory material on to the aluminium coating so formed.

The spray heads by which the aluminium and refractory materials are sprayed can be located alongside each other and moved relatively to the carbon electrode simultaneously, the distance apart of the spray heads being sufficient to ensure that there is virtually no interference between the sprays of aluminium and refractory material, and also to ensure that the heat of the molten aluminium does not dry out the refractory material before it reaches the surface of the carbon article.

Preferably, the refractory spray is a pneumatic spray and the refractory is contained in a slurry having a water base together with a thickening agent. A preferred thickening agent is Cellofas B.50 which is produced by Imperial Chemical Industries Ltd. Cellofas B.50 is sodium carboxymethyl cellulose and is available in both granulated and powder form. A possible refractory material which may be used comprises aluminium powder, titanium dioxide, silicon metal powder, silicon carbide boric acid ferrochrome, bichromium trioxide and zirconium silicate.

From another aspect the invention comprises apparatus for applying a protective coating to the surface of a carbon article, the apparatus consisting of means to support and rotate the carbon article and two spray heads, one for aluminium and the other for refractory material, the spray heads being mounted on a carriage, movable longitudinally of the carbon article, the spacing of the spray heads being such that they allow two sprays to reach the surface of the carbon article without interference with each other and also such that the heat of the molten aluminium will not dry out the refractory spray before it reaches the carbon article.

Figure 1:
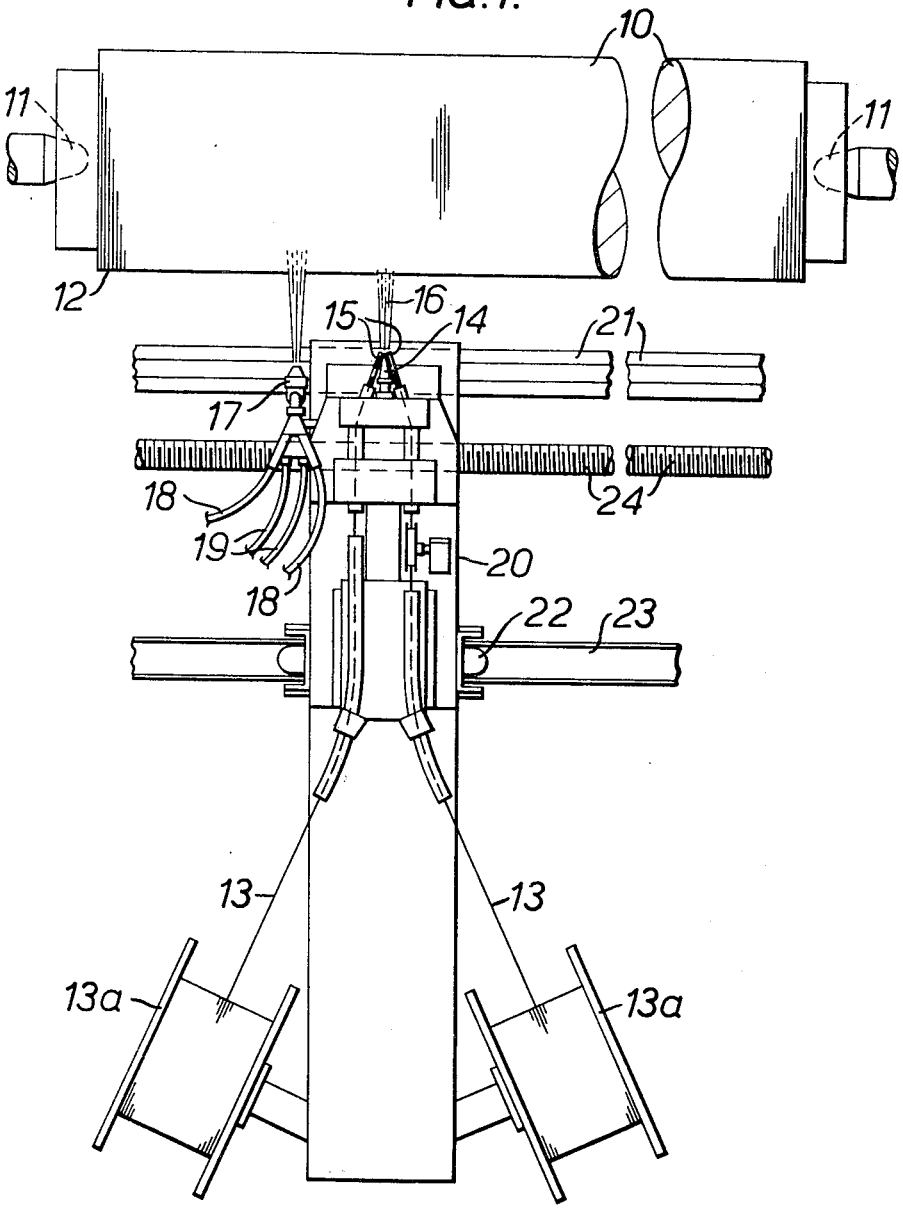
FIG. 1 is a diagrammatic plan of an apparatus, embodying the invention, for creating a protective coating on the surface of a large carbon electrode.
Figure 2:
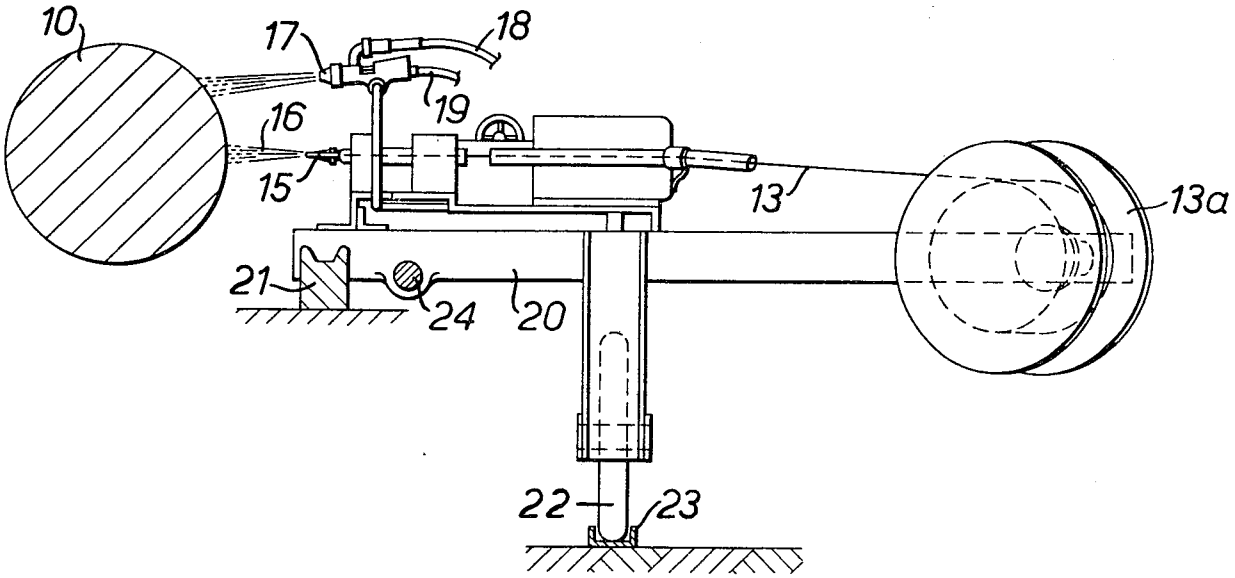
FIG. 2 is an end elevation, partly in section and on a reduced scale, of the same apparatus.

A carbon electrode, of the kind used in large electric furnaces for steel refining, is preheated to about 100° – 150°C to remove moisture and to ensure that when material is subsequently sprayed on to the electrode it dries rapidly.

The three stages of coating then commence. In the first stage there are three steps:

a. Spray aluminium on to the electrode surface.

b. Spray refractory materials on to the aluminium coated surface.

c. Use an electric arc to fuse the refractory and the aluminium.

The second stage repeats the first three steps identically. In the third stage there is no refractory spray but graphite is sprayed. Thus the third stage consists of:

a. Spray aluminium b. Spray graphite c. Fuse the graphite and aluminium by an electric arc.

As shown in the drawings, during the spraying operations the electrode 10 which is to be sprayed is supported in a lathe. To support the electrode 10 a nipple 11 is screwed into the central bore at each end of the electrode 10. This central bore is already threaded because it is normally used to attach one electrode to the next as they are consumed. The electrode surface is prepared by removal of dirt, paint and grease by a very light machining process. During this process gramophone type grooves 12 are formed which assist in the bonding of the material subsequently and also increase surface area.

The carbon electrode surface is then sprayed with aluminium by an electric arc process in which aluminium rods 13, wound on drums 13*a*, are fed into a gap 14 between arc electrodes 15 and the atomised aluminium is blown by an air jet on to the carbon electrode surface. During spraying the carbon electrode 10 is slowly rotated and a band of aluminium about 1 inch wide is sprayed so as to form continuous spiral coating of aluminium on the electrode surface. A refractory spray head is mounted alongside the aluminium spray, about 4–5 inches laterally displaced from the aluminium spray. A 1 inch band of refractory is sprayed on top of the aluminium at the same time as the aluminium is being sprayed further along the electrode. This gap between the two sprays is necessary for two reasons. Firstly, it avoids the possibility of substantial interference between the aluminium and refractory sprays, and secondly it avoids the drying effect of the heat from the aluminium spray on the refractory spray. If the two sprays were any closer the refractory spray would dry out before it hit the aluminium surface.

The distances separating the two sprays are important, but these are variable and are dependent upon the rate at which the aluminium spray operates, e.g. at lower current settings, say 200 amperes, the aluminium spraying generator requires a lower volume of air to deposit the aluminium on the electrode, causing the overspray to be much less and consequently, in this case, the refractory spray gun could be located much closer, approx. 3 inches distant. Conversely, when spraying at 450–500 amps., the separation needs to be 5 inches minimum. In all cases the spray heads are separated in the vertical plane by some 4 inches.

The aluminium spray and refractory spray heads are both mounted on a carriage 20 which is supported on a grooved rail 21 and by a wheel 22 running in another rail 23. The carriage is traversed automatically by lead screw 24.

The refractory spray is provided by a normal pneumatic paint spray gun, comprising spray head 17 and pipes 18 for the supply of air and 19 for supply of refractory, the refractory being in the form of a slurry contained in a normal paint pressure pot. The slurry may, for example, consist of aluminium powder, silicon carbide, silicon, titanium dioxide, boric acid, ferrochrome, birchromium trioxide, zirconium silicate water and Cellofas. The Cellofas is a thickening agent and is mixed with the water first. The other ingredients are powdered and mixed together and then thoroughly mixed in the Cellofas/water.

This spray technique replaces a technique in which refractory material was hand-painted on to the aluminium. Hand-painting takes much longer and it was necessary to wait until the electrode had been completely coated in aluminium before hand-painting could commence and it was also necessary to wait until the electrode had cooled. The refractory spray can be used simultaneously with the aluminium spray thus cutting out one of the steps in the manufacturing process. The saving in time is particularly valuable after the second aluminium coating because at this stage the time required for cooling prior to hand-painting is quite large.

In the third stage of the process the graphite is applied preferably by spraying.

It is very important in preparing materials for spraying to make sure that the refractory materials are evenly distributed in the slurry. The titanium tends to form small globules which clog the spray nozzle and this can be overcome by adequate mixing of the titanium with the other powdered materials before they are mixed into the Cellofas/water mixture. The Cellofas/water mixture is made up by mixing 2–2½% by weight of Cellofas in warm water at a temperature of about 60°–80°C which ensures that the Cellofas dissolves quickly. Some of the materials used are as follows:

| | |
|---|---|
| Aluminium Power | Ferrochrome |
| Titanium Dioxide | Boric Acid |
| Silicon Metal Powder | Bichromium Tioxide |
| Silicon Carbide | Zirconium Silicate |

These components are thoroughly mixed in dry powder form. 1250 grams of the dry mixture are then mixed into 1250 c.c. of water which already contains 2–2½% by weight of Cellofas. This quantity of slurry is sufficient to coat an electrode 8 feet long and 24 inches diameter, i.e. about 50 sq. ft. of surface. The above mixture is used for the refractory spray coating.

We claim:

1. Apparatus for applying a protective coating to the surface of a carbon article, said apparatus comprising means to support and rotate said carbon article, a carriage adjacent said carbon article, a first spray head secured to said carriage and directed toward said carbon article, a source of aluminum, means delivering aluminum from said source to said first spray head, means for melting said aluminum so that said first spray head sprays molten aluminum on said carbon article, a second spray head secured to said carriage and directed toward said carbon article, a source of liquid containing refractory material, means delivering said liquid containing refractory material to said second spray head, and means for moving said carriage longitudinally of said carbon article in a direction such that said carbon article is sprayed first with molten aluminum and then with refractory material, the spacing between said spray heads being such that the sprays of aluminum and refractory material reach the carbon article without interference with each other and such that heat from molten aluminum sprayed by said first spray head does not dry out the refractory material before it reaches said carbon article.

* * * * *